US011143447B2

(12) United States Patent
Seong et al.

(10) Patent No.: US 11,143,447 B2
(45) Date of Patent: Oct. 12, 2021

(54) REFRIGERATOR

(71) Applicant: LG ELECTRONICS INC., Seoul (KR)

(72) Inventors: Giseok Seong, Seoul (KR); Kyungseok Kim, Seoul (KR); Kyeongyun Kim, Seoul (KR); Seunguk Ahn, Seoul (KR); Myungjin Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 217 days.

(21) Appl. No.: 16/222,443

(22) Filed: Dec. 17, 2018

(65) Prior Publication Data

US 2019/0186803 A1 Jun. 20, 2019

(30) Foreign Application Priority Data

Dec. 19, 2017 (KR) ..... 10-2017-0175056

(51) Int. Cl.
*F25B 13/00* (2006.01)
*F25D 11/02* (2006.01)
(Continued)

(52) U.S. Cl.
CPC ..... *F25D 11/022* (2013.01); *F25B 13/00* (2013.01); *F25B 49/02* (2013.01); *F25D 17/065* (2013.01);
(Continued)

(58) Field of Classification Search
CPC ..... F25D 1/022; F25D 11/022; F25D 17/065; F25D 21/065; F25B 2600/2511
See application file for complete search history.

(56) References Cited

U.S. PATENT DOCUMENTS 5,816,054 A * 10/1998 Yoo ..... F25B 5/04 62/80
6,058,723 A * 5/2000 Kusunoki ..... F25D 17/065 62/155
(Continued)

FOREIGN PATENT DOCUMENTS

CN 105466115 A 4/2016
JP H11304344 A * 4/1998 ..... F25B 2600/2511
(Continued)

OTHER PUBLICATIONS

Minoru, Refrigerator, 1998, Full Document (Year: 1998).*

*Primary Examiner* — Elizabeth J Martin
*Assistant Examiner* — Nael N Babaa
(74) *Attorney, Agent, or Firm* — Dentons US LLP

(57) ABSTRACT

A refrigerator including a compressor, a condenser, a freezing chamber evaporator, a freezing chamber fan, a defrosting heater, a wine chamber evaporator, a wine chamber fan, a path switching device configured to guide the refrigerant condensed in the condenser to the freezing chamber evaporator in a freezing chamber mode and to guide the refrigerant condensed in the condenser to the wine chamber evaporator in a wine chamber mode, and a controller configured to turn on the defrosting heater to perform a freezing chamber defrosting mode for defrosting the freezing chamber evaporator, to control the path switching device to the wine chamber mode while the temperature of the wine chamber is dissatisfied when the temperature of the wine chamber is dissatisfied in the freezing chamber defrosting mode, and to drive the wine chamber fan.

20 Claims, 7 Drawing Sheets

(51) Int. Cl.

| | |
|---|---|
| ***F25D 21/08*** | (2006.01) |
| ***F25B 49/02*** | (2006.01) |
| ***F25D 17/06*** | (2006.01) |
| ***F25D 21/00*** | (2006.01) |

(52) U.S. Cl.
CPC ..... *F25D 21/006* (2013.01); *F25D 21/08* (2013.01); *F25B 2600/2511* (2013.01); *F25D 2331/803* (2013.01)

(56) References Cited

U.S. PATENT DOCUMENTS

| | | | | |
|---|---|---|---|---|
| 2007/0137230 | A1 | 6/2007 | Bae et al. | |
| 2015/0033773 | A1* | 2/2015 | Tajima | F25D 17/045 62/80 |
| 2017/0030627 | A1* | 2/2017 | Kim | F25B 41/04 |

FOREIGN PATENT DOCUMENTS

| | | | |
|---|---|---|---|
| JP | 11304344 | A | 11/1999 |
| JP | 2001027471 | A | 1/2001 |
| JP | 2002062026 | A | 2/2002 |
| JP | 2005024203 | A | 1/2005 |
| JP | 2017190936 | A | 10/2017 |
| KR | 10-2006-08680 | A | 8/2006 |
| KR | 10-2008-89966 | A | 3/2009 |

* cited by examiner

REFRIGERATOR

This application claims priority under 35 U.S.C. 119 and 365 to Korean Patent Application No. 10-2017-0175056, filed on Dec. 19, 2017 in the Korean Intellectual Property Office, the disclosure of which is incorporated herein by reference.

BACKGROUND

1. Field of the Disclosure

The present disclosure relates to a refrigerator, and more particularly, to a refrigerator having a plurality of evaporators for cooling a plurality of storage chambers.

2. Discussion of the Related Art

A refrigerator is a device for cooling or storing objects to be cooled (hereinafter, referred to as food) at a low temperature to prevent food from spoiling or going sour, or preserve medicines and cosmetics.

The refrigerator includes a main body having at least one storage chamber formed therein and a freezing cycle device for cooling the storage chamber. The main body may include a plurality of storage chambers having different temperature ranges.

In recent years, refrigerators for storing foods, which need to be stored at a constant temperature, such as wine, have gradually increased. Korean patent registration No. 10-0889966 B1 (published on Mar. 24, 2009) discloses a wine refrigerator capable of refrigerating wine.

The wine refrigerator disclosed in Korean patent registration No. 10-0889966 B1 (published on Mar. 24, 2009) includes a wine storage space in which wine is received, a freezing system for cooling air inside of the wine storage space, a heater for partially heating the air inside of the wine storage space, an evaporator temperature sensor for measuring the temperature of the evaporator of the freezing system, and a controller for controlling operation of the freezing system and the heater. Since circulated air is generated in the wine refrigerator by the heater, the internal temperature of the wine refrigerator may be maintained in an optimal temperature range. In addition, in such a wine refrigerator, a first wine chamber evaporator, a second wine chamber evaporator and a freezing chamber evaporator respectively perform evaporation in an upper, middle and lower layers of the wine storage space, thereby separately performing temperature control.

However, the above-described wine refrigerator may store wine and food having a storage temperature close to that of wine, but cannot suitably store food having a lower storage temperature than wine, such as meat, together with wine.

SUMMARY

An object of the present disclosure is to provide a refrigerator capable of maintaining a wine chamber at a constant temperature as much as possible.

To achieve the above objects, there is provided a refrigerator including a compressor configured to compress refrigerant, a condenser configured to condense the refrigerant compressed in the compressor, a freezing chamber evaporator configured to cool a freezing chamber, a freezing chamber fan configured to circulate cool air of the freezing chamber to the freezing chamber and the freezing chamber evaporator, a defrosting heater configured to defrost the freezing chamber evaporator, a wine chamber evaporator configured to cool a wine chamber, a wine chamber fan configured to circulate cool air of the wine chamber to the wine chamber and the wine chamber evaporator, a path switching device configured to guide the refrigerant condensed in the condenser to the freezing chamber evaporator in a freezing chamber mode and to guide the refrigerant condensed in the condenser to the wine chamber evaporator in a wine chamber mode, and a controller configured to turn on the defrosting heater to perform a freezing chamber defrosting mode for defrosting the freezing chamber evaporator, to control the path switching device to the wine chamber mode and drive the compressor and the wine chamber fan while the temperature of the wine chamber is dissatisfied when the temperature of the wine chamber is dissatisfied in the freezing chamber defrosting mode.

The controller may drive the compressor, drive the wine chamber fan, and control the path switching device to the wine chamber mode to perform a wine chamber pre-cool mode, stop the wine chamber fan in the wine chamber pre-cool mode, drive the freezing chamber fan, and control the path switching device to the freezing chamber mode to perform a freezing chamber pre-cool mode. The freezing chamber defrosting mode may start after terminating the freezing chamber pre-cool mode.

The wine chamber pre-cool mode may terminate when a first set time has elapsed after the wine chamber pre-cool mode starts.

The freezing chamber pre-cool mode may terminate when a second set time has elapsed after the freezing chamber pre-cool mode starts or when a temperature of the freezing chamber is lower than a target temperature of the freezing chamber by a set temperature.

The second set time may be greater than the first set time.

The controller may perform an alternate cooling mode for alternately cooling the wine chamber and the freezing chamber after terminating the freezing chamber defrosting mode.

The controller may alternately perform a wine chamber cooling mode for driving the wine chamber fan and controlling the path switching device to the wine chamber mode and a freezing chamber cooling mode for driving the freezing chamber fan and controlling the path switching device to the cooling chamber mode, in the alternate cooling mode. The controller may drive the compressor in the alternate cooling mode.

The controller may first start the wine chamber cooling mode when a set waiting time has elapsed after terminating the freezing chamber defrosting mode.

The controller may perform the wine chamber cooling mode and the freezing chamber mode for the same set time.

The controller may terminate the alternate cooling mode when a temperature of the freezing chamber is satisfied in the alternate cooling mode.

The controller may perform a freezing chamber additional cooling mode for additionally cooling the freezing chamber when a defrosting condition of the freezing chamber evaporator is satisfied. The controller may perform a first mode for driving the compressor, driving the freezing chamber fan and driving the wine chamber fan and a second mode for closing the path switching device when an additional set time has elapsed after the freezing chamber additional cooling mode starts or when a temperature of the freezing chamber is satisfied, in the freezing chamber additional cooling mode. The second mode may be performed in the middle of the first mode. The controller may stop the compressor and the freezing chamber fan when a pump-down set time has elapsed after the second mode.

The controller may perform a wine chamber additional defrosting mode for additionally driving the wine chamber fan after stopping the compressor and the freezing chamber fan. The wine chamber additional defrosting mode may terminate when a temperature of the wine chamber is a natural defrosting termination temperature or when a set additional driving time has elapsed after the wine chamber additional defrosting mode starts.

The wine chamber pre-cool mode may start when a set stopping time has elapsed after the wine chamber additional defrosting mode terminates.

DETAILED DESCRIPTION OF THE PREFERRED EMBODIMENTS

Hereinafter, detailed embodiments of the present disclosure will be described in detail with reference to the accompanying drawings.

Figure 1:
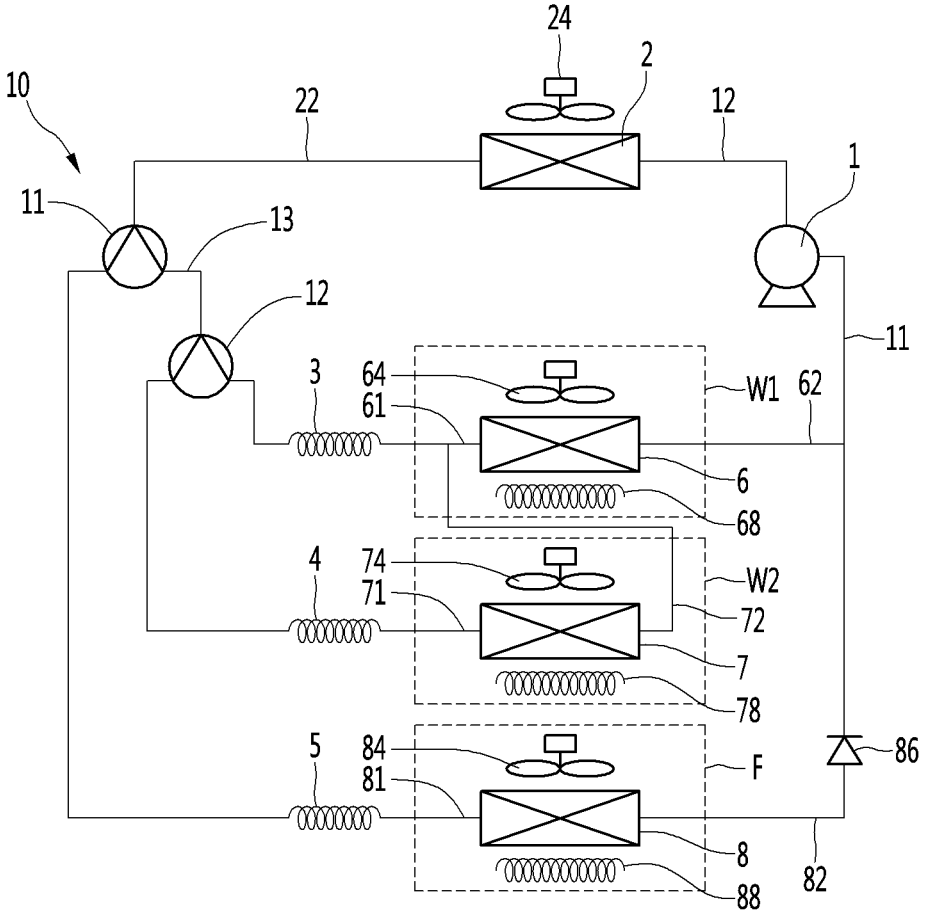
FIG. 1 is a diagram showing a configuration of a refrigerator according to an embodiment of the present disclosure.
Figure 2:
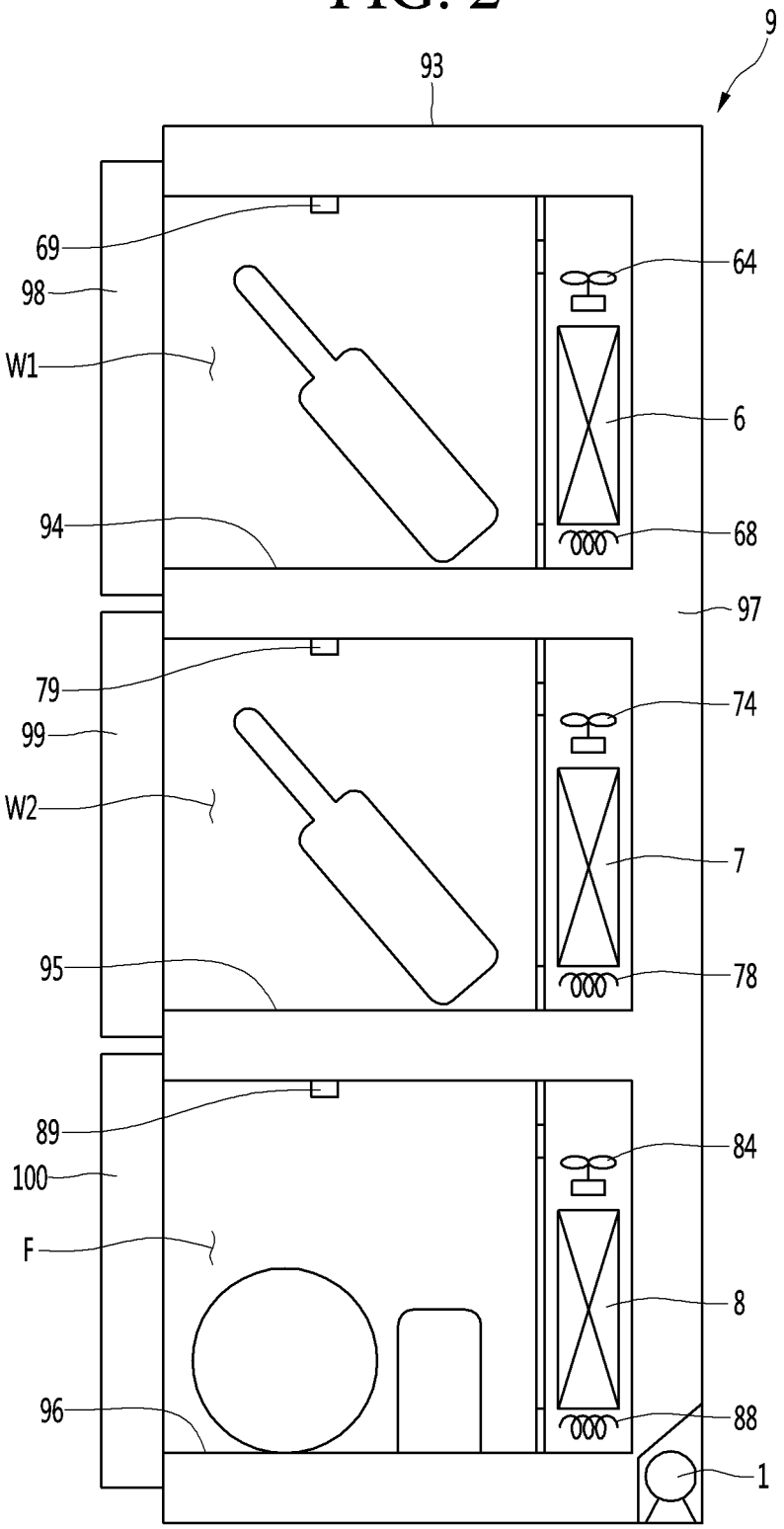
FIG. 2 is a cross-sectional view showing an inside of the refrigerator according to the embodiment of the present disclosure.
Figure 3:
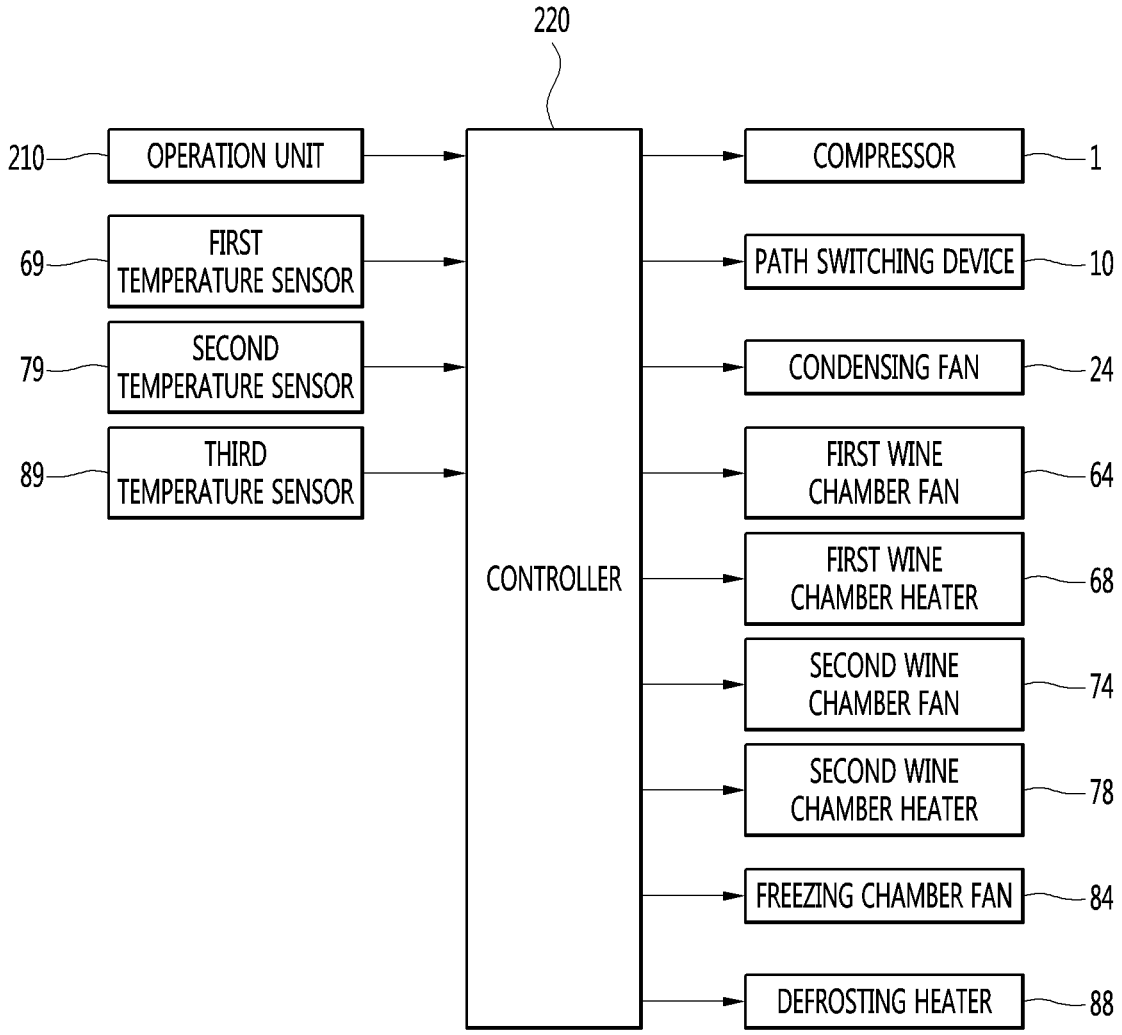
FIG. 3 is a control block diagram of the refrigerator according to the embodiment of the present disclosure.

FIG. 1 is a diagram showing a configuration of a refrigerator according to an embodiment of the present disclosure, FIG. 2 is a cross-sectional view showing an inside of the refrigerator according to the embodiment of the present disclosure, and FIG. 3 is a control block diagram of the refrigerator according to the embodiment of the present disclosure.

In the refrigerator of the present embodiment, at least one first storage chamber and at least one second storage chamber may be formed.

Hereinafter, at least one first storage chamber will be referred to as a first storage chamber for convenience, and at least one second storage chamber will be referred to as a second storage chamber.

The first storage chamber and the second storage chamber can be temperature-controlled with different temperature ranges from each other.

One of the first storage chamber and the second storage chamber may have a relatively higher temperature range than the other. The storage chamber having a high temperature range may be a storage chamber having a temperature range of more than 0° C.

The first storage chamber may be a storage chamber having a temperature range of 10° C. to 20° C. and the first storage chamber may be a temperature controlled storage room based on a target temperature selected by a user from a temperature range of 10° C. to 20° C.

The second storage chamber may be a storage chamber having a temperature range lower than the temperature range of the first storage chamber, for example, a storage chamber having a temperature range of −24° C. to 7° C. The second storage chamber may be a temperature-controlled storage chamber based on a target temperature selected by a user in a temperature range of −24° C. to 7° C.

The second storage chamber may be a switchable chamber (or a temperature-changeable chamber) in which any one among a plurality of temperature ranges can be selected. On the other hand, the second storage chamber may be a non-switchable chamber having one temperature range.

The first storage room may be a wine chamber in which wine is stored or wine is mainly stored. The second storage room may be a non-wine chamber in which articles other than wine are stored or articles other than wine are mainly stored.

The non-wine chamber may be a separate storage chamber that is distinct from the wine chamber.

The non-wine chamber may be a refrigerating chamber having a temperature range of more than 0° C. The non-wine chamber may be a freezing chamber having a temperature range of less than 0° C. The non-wine chamber may be a special chamber having a temperature range between the temperature range of the refrigerating chamber and the temperature range of the freezing chamber. The non-wine chamber may be a switchable room in which one of the refrigerating chamber, the freezing chamber and the special chamber can be selected.

The plurality of storage chambers can be classified into a first storage chamber having a relatively high temperature range and a second storage chamber having a temperature range lower than that of the first storage chamber.

Each of the first storage chamber and the second storage chamber can be temperature-controlled according to a target temperature upper-limit value and a target temperature lower-limit value.

One of the first storage chamber and the second storage chamber may be a storage chamber having a small difference (for example, 0.5° C.) between the target temperature upper-limit value and the target temperature, and a small difference (for example, 0.5° C.) between the target temperature and the target temperature lower-limit value.

The other of the first storage room and the second storage room may be a storage chamber having a large difference (for example, 1° C.) between the target temperature upper limit-value and the target temperature and a large difference (for example, 1° C.) between the target temperature and the target temperature lower-limit value.

A storage chamber having a relatively small difference may be defined as a constant temperature chamber.

When compared with the constant temperature chamber, the storage chamber having a relatively large difference may be defined as a non-constant temperature chamber.

The constant-temperature chamber and the non-constant temperature chamber may be terms for distinguishing each other based on the difference (for example, 0.5° C. and 1° C.).

One of the first storage chamber and the second storage chamber may be a priority chamber controlled prior to other storage chamber.

The other of the first storage chamber and the second storage chamber may be a subordinate chamber that is controlled in a relatively lower order than the priority chamber.

The refrigerator may store at least one first item having a large quality change due to a temperature change and at least one second item having a relatively small quality change due to a temperature change.

The refrigerator may store at least one first item that is expensive and at least one second item that is relatively inexpensive.

The first item having a large quality change due to the temperature change can be stored in priority chamber, and the second item having a small quality change due to the temperature change can be stored in the subordinate chamber.

The first item, which is expensive, may be stored in priority chamber, and the second item, which is inexpensive, may be stored in the subordinate chamber.

The refrigerator can be controlled based on the priority chamber and the subordinate chamber.

The priority chamber may be a storage chamber that is cooled before the subordinate chamber if a temperature of the priority chamber is unsatisfactory and a temperature of the subordinate chamber is unsatisfactory.

The priority chamber may be a storage chamber that is cooled or heated during the subordinate chamber defrost mode in which an evaporator for cooling the subordinate chamber is defrosted if the temperature of the priority chamber is unsatisfactory.

The plurality of storage chambers formed in the refrigerator can be classified into the wine chamber and the non-wine chamber, or can be divided into the constant temperature chamber and the non-constant temperature chamber, or can be the priority chamber and the subordinate chamber.

Hereinafter, for the sake of convenience, the terms of the wine chamber are used to describe the priority chamber and the constant temperature chamber, and the terms of the freezing chamber, which is one example of non-wine chamber, are used to describe the subordinate chamber and the non-constant temperature chamber. However, it goes without saying that the plurality of storage chambers of the present invention are not limited to the wine chamber and the freezing chamber.

In the refrigerator, the freezing chamber F and at least one the wine chamber W1 or W2 may be formed. The refrigerator includes a compressor 1, a condenser 2, at least one expansion device 3, 4 or 5, at least one evaporator 6 or 7, a freezing chamber evaporator 8, a path switching device 10, wine chamber fans 64 and 74, a freezing chamber fan 84, a defrosting heater 88 and a controller 220. The controller 220 may be an electronic circuit including a microprocessor, a logical electronic circuit, or a custom integrated circuit.

The refrigerator may include a main body 9 in which the freezing chamber F and the at least one the wine chamber W1 or W2 are formed. The compressor 1, the condenser 2, the at least one expansion device 3, 4 or 5, the at least one evaporator 6 or 7, the freezing chamber evaporator 8, the path switching device 10, the wine chamber fans 64 and 74, the freezing chamber fan 84, the defrosting heater 88 and the controller 220 may be provided in the main body 9.

The at least one wine chamber W1 or W2 and the freezing chamber F may be partitioned and formed in the main body 9 and may be independent storage spaces.

The refrigerator may include one wine chamber W1 and one freezing chamber F, and the wine chamber and the freezing chamber F may be partitioned by a barrier.

The refrigerator may include a plurality of wine chambers W1 and W2 and one freezing chamber F, and the plurality of wine chambers W1 and W2 and the freezing chamber F may be partitioned by a plurality of barriers. The refrigerator may include the freezing chamber F and a pair of wine chambers W1 and W2, any one (e.g., wine chamber W2) of the pair of wine chambers W1 and W2 may be separated from the other (e.g., wine chamber W1) of the pair of wine chambers W1 and W2 by a first barrier. Any one (e.g., wine chamber W2) of the pair of wine chambers W1 and W2 may be separated from the freezing chamber F by a second barrier.

The main body 9 may include an outer case 93 forming appearance thereof, a wine chamber inner case 97 in which a wine chamber is formed, a freezing chamber inner case 96 in which the freezing chamber F is formed. If the main body 9 includes a pair of wine chambers W1 and W2, the wine chamber inner case may include a first wine chamber inner case 94 in which the first wine chamber W1 is formed and a second wine chamber inner case 95 in which the second wine chamber W2 is formed.

The main body 9 may include an insulator 97 for insulating the inside of the refrigerator. The insulator 97 may be disposed between the wine chamber inner case and the outer case 93, between the freezing chamber inner case 96 and the outer case 93, between the wine chamber inner case and the freezing chamber inner case 96. If the main body 9 includes a pair of wine chamber inner cases 94 and 95, the second wine chamber inner case 95 may be located between the first wine chamber inner case 94 and the freezing chamber inner case 96.

The main body 9 may include a door for opening or closing the wine chamber W1 or W2 and a door for opening or closing the freezing chamber F. If a pair of wine chambers W1 and W2 is formed in the main body 9, the main body 9 may include a first door 98 for opening or closing the first wine chamber W, a second door 99 for opening or closing the second wine chamber W2, and a third door 100 for opening or closing the freezing chamber F.

The wine chamber may be a wine-only storage chamber capable of mainly storing red wine or white wine. The wine chamber may be cooled in a temperature range in which wine is stored with optimal quality.

If the refrigerator includes a pair of wine chambers W1 and W2, the first wine chamber W1 may be a red wine chamber capable of mainly refrigerating red wine and the second wine chamber W2 may be a switchable wine chamber of selectively refrigerating red wine and white wine.

In contrast, the freezing chamber F may be a low-temperature storage chamber having a lower temperature range than the wine chambers W1 and W2, that is, the first wine chamber W1 and the second wine chamber W2.

Hereinafter, the first wine chamber W1 and the second wine chamber W2 may have the same or similar temperature range and the other configurations other than the temperature range may be the same. Hereinafter, the common configurations of the first wine chamber W1 and the second wine chamber W2 will be described as the wine chambers W1 and W2 and different configurations of the first wine chamber W1 and the second wine chamber W2 will be described as the first wine chamber W1 and the second wine chamber W2.

Meanwhile, the present invention is not limited to the refrigerator including a pair of wine chambers W1 and W2 and the refrigerator may include one wine chamber and one freezing chamber F.

The first wine chamber W1 may have a fixed temperature range. Alternatively, the temperature range of the first wine chamber W1 may vary and a user may select a specific temperature in a temperature range of the first wine chamber W1 as a desired temperature.

The temperature range of the first wine chamber W1 may be, for example, set in a range of 10° C. to 20° C., and, preferably, in the storage temperature range of red wine, for example, 12° C. to 18° C.

The user may input a target temperature of the first wine chamber W1 through an operation unit 210, and the target temperature of the first wine chamber W1 may be a specific temperature selected by the user in the temperature range of the red wine of 12° C. to 18° C.

The second wine chamber W2 may have a temperature range selected by the user from among the plurality of temperature ranges.

The temperature range of the second wine chamber W2 may be higher than that of the freezing chamber F. In addition, the temperature range of the second wine chamber W2 may be equal to or lower than that of the first wine chamber W1.

An example of the temperature range of the second wine chamber W2 may be set in a range of 10° C. to 20° C. and, preferably in the temperature range of red wine of, for example, 12° C. to 18° C.

Another example of the temperature range of the second wine chamber W2 may be set in a range of 4° C. to 13° C. and, preferably in the temperature range of white wine of, for example, 6° C. to 11° C.

The refrigerator may include the operation unit 210 capable of selecting the temperature range of the second wine chamber W2. The user may set the temperature range of the second wine chamber W2 to be equal to that of the first wine chamber W1 or set the temperature range of the second wine chamber W2 to be lower than that of the first wine chamber W1, using the operation unit 210.

The user may set the second wine chamber W2 to a red wine mode through the operation unit 210, and, in this case, the second wine chamber W2 may become a red wine chamber cooled to the temperature range of red wine of, for example, 12° C. to 18° C.

The user may set the second wine chamber W2 to a white wine mode through the operation unit 210, and, in this case, the second wine chamber W2 may be a withe wine chamber cooled to the temperature range of white wine of, for example, 6° C. to 11° C.

The user may input the target temperature of the second wine chamber W2 through the operation unit 210. In this case, the target temperature of the second wine chamber W2 may be a specific temperature selected by the user in the temperature range of red wine of 12° C. to 18° C. or a specific temperature selected by the user in the temperature range of white wine of 6° C. to 11° C.

The freezing chamber F may be a normal storage chamber having a lower temperature range than the wine chamber and, more particularly, the first wine chamber W1 and the second wine chamber W2.

Meanwhile, the freezing chamber F may have a selectable temperature range, and may be composed of a switchable chamber (or a temperature-changeable chamber) having a temperature range selected from among a plurality of temperature ranges.

The user may set the freezing chamber F to a refrigerating chamber mode using the operation unit 210. In this case, the temperature range of the freezing chamber F may be set to the temperature range of the refrigerating chamber of 0° C. to 7° C. In addition, the user may input a desired refrigerating temperature using the operation unit 210, and the target temperature of the freezing chamber F may be a specific temperature selected by the user in a range of 0° C. to 7° C.

The user may set the freezing chamber F to a freezing chamber mode using the operation unit 210. In this case, the temperature range of the freezing chamber F may be set to the temperature range of the freezing chamber of −24° C. to −16° C. In addition, the user may input a desired freezing temperature using the operation unit 210, and the target temperature of the freezing chamber F may be a specific temperature selected by the user in a range of −24° C. to −16° C.

The user may set the freezing chamber F to a special mode (e.g., a kimchi storage mode) using the operation unit 210. In this case, the temperature range of the freezing chamber F may be set to the temperature range of the special mode of −2° C. to 0° C. In addition, the user may input a desired storage chamber temperature using the operation unit 210, and the target temperature of the freezing chamber F may be a specific temperature selected by the user in a range of −2° C. to 0° C.

The maximum target temperature of the freezing chamber F may be lower than the maximum target temperature of the wine chamber, that is, each of the maximum target temperatures of the first wine chamber W1 and the second wine chamber W2.

The wine chambers W1 and W2 may mainly store food which needs to be stored at a constant temperature (such as, wine) and the maximum target temperature thereof may be high. The freezing chamber F may store food having a lower storage temperature than white wine or red wine and the maximum target temperature thereof may be low.

For example, the temperature range of the freezing chamber F may be −24° C. to −16° C., the temperature range of the first wine chamber W1 may be 12° C. to 18° C., and the temperature range of the second wine chamber W2 may be 6° C. to 11° C. In this case, −24° C. which is the maximum target temperature of the freezing chamber F is lower than each of than 18° C. which is the maximum target temperature of the first wine chamber W1 and 11° C. which is the maximum target temperature of the second wine chamber W2.

Meanwhile, a difference between the target temperature upper-limit value and the target temperature lower-limit value of the wine chambers W1 and W2 may be lower than a difference between the target temperature upper-limit value and the target temperature lower-limit value of the freezing chamber F.

Since the wine chambers W1 and W2 store food which needs to be stored at a constant temperature (such as, wine), a temperature change width thereof may be controlled not to be high.

In contrast, since the freezing chamber F stores food having a lower storage temperature than white wine or red wine, the temperature change width of the freezing chamber F may be controlled to be greater than that of the wine chamber, such that the freezing chamber F is sufficiently cooled.

The target temperature upper-limit value of the first wine chamber W1 is higher than the target temperature of the first wine chamber W1 by 0.5° C., and the target temperature lower-limit value of the first wine chamber W1 may be lower than the target temperature of the first wine chamber W1 by 0.5° C.

In addition, the target temperature upper-limit value of the second wine chamber W2 is higher than the target temperature of the second wine chamber W2 by 0.5° C., and the target temperature lower-limit value of the second wine chamber W2 may be lower than the target temperature of the second wine chamber W2 by 0.5° C.

In contrast, the target temperature upper-limit value of the freezing chamber F is higher than the target temperature of the freezing chamber F by 1° C. or 1.5° C., and the target temperature lower-limit value of the freezing chamber F may be lower than the target temperature of the freezing chamber F by 1° C. or 1.5° C.

According to the present embodiment, the second wine chamber W2 may be located between the first wine chamber W1 and the freezing chamber F. The first wine chamber W1 may be configured as an upper chamber located above the second wine chamber W2, the freezing chamber F may be configured as a lower chamber located below the second wine chamber W2, and the second wine chamber W2 may be configured as a middle chamber located between the first wine chamber W1 and the freezing chamber F.

In this case, the second wine chamber W2 capable of refrigerating white wine or red wine may be located between the freezing chamber F and the first wine chamber W1.

The compressor 1 compresses refrigerant and may be connected with a compressor suction path 11 and a compressor discharge path 12. The compressor 1 may suck and compress the refrigerant of the compressor suction path 11 and then discharge the refrigerant to the compressor discharge path 12.

The condenser 2 may be connected with the compressor discharge path 12. The condenser 2 may be connected with a condenser outlet path 22. Refrigerant compressed in the compressor 1 and then discharged through the compressor discharge path 12 may be introduced into the condenser 2, condensed while passing through the condenser 2, and then discharged through the condenser outlet path 22.

The refrigerator may further include a condensing fan 24 for blowing outside air to the condenser 2.

The expansion devices 3, 4 and 5 may decompress and expand refrigerant flowing to the evaporators 6, 7 and 8 after being condensed in the condenser 2. The expansion devices 3, 4 and 5 may be capillary tubes or electronic expansion valves.

The expansion devices 3, 4 and 5 may have one-to-one correspondence with the plurality of evaporators 6, 7 and 8 provided in the refrigerator. The number of evaporators 6, 7 and 8 may be equal to the number of wine chambers W1 and W2 plus the number of freezing chamber F.

The evaporators 6 and 7 cool the wine chambers W1 and W2 and the number thereof may be equal to or greater than the number of wine chambers W1 and W2. The freezing evaporator 8 cools the freezing chamber and the number thereof may be equal to or greater than the freezing chamber F.

The plurality of wine chambers W1 and W2 may be formed in the refrigerator, and the plurality of wine chamber evaporators 6 and 7 may include the first wine chamber evaporator 6 for cooling the first wine chamber W1 and the second wine chamber evaporator 7 for cooling the second wine chamber W2.

The plurality of expansion devices 3, 4 and 5 may include the wine chamber expansion devices 3 and 4 for decompressing the refrigerant flowing toward the wine chamber evaporators 6 and 7 and the freezing chamber expansion device 5 provided in the freezing chamber evaporator inlet path 81 to decompress the refrigerant flowing toward the freezing chamber evaporator 8.

If the wine chamber evaporators 6 and 7 include the first wine chamber evaporator 6 and the second wine chamber evaporator 7, the expansion devices 3 and 4 may include the first expansion device 3 installed in a first wine chamber evaporator inlet path 61 to decompress refrigerant flowing toward the first wine chamber evaporator 6; and the second expansion device 4 installed in a second wine chamber evaporator inlet path 71 to decompress refrigerant flowing toward the second wine chamber evaporator 7.

The plurality of evaporators 6, 7 and 8 may be connected in series, or the first wine chamber evaporator 6 and the second wine chamber evaporator 7 connected in series may be connected to the freezing chamber evaporator 8 in parallel.

The first wine chamber evaporator 6 may be connected with a first wine chamber evaporator inlet path 61 and a first wine chamber evaporator outlet path 62 to cool the first wine chamber W1. The first wine chamber evaporator outlet path 62 may be connected to the compressor suction path 11. One end of the first wine chamber evaporator outlet path 62 may be connected to the first wine chamber evaporator 6 and another end of the first wine chamber evaporator outlet path 62 may be connected between a valve 86 and the compressor 1 in a direction in which the refrigerant passing through the freezing chamber evaporator 8 flows.

The refrigerant, which has passed through the first wine chamber evaporator 6, may be sucked into the compressor 1 through the first wine chamber evaporator outlet path 62 and the compressor suction path 11.

The refrigerator may include a first wine chamber fan 64 for circulating cool air of the first wine chamber W1 to the first wine chamber evaporator 6 and the first wine chamber W1.

The second wine chamber evaporator 7 may be connected with a second wine chamber evaporator inlet path 71 and a second wine chamber evaporator outlet path 72 to cool the second wine chamber W2.

The second wine chamber evaporator outlet path 72 may be connected to the first wine chamber evaporator inlet path 61. The second wine chamber evaporator outlet path 72 may be connected between the first expansion device 3 and the first wine chamber evaporator 6 at the first wine chamber evaporator inlet path 61. In this case, the second wine chamber evaporator 7 may be connected to the first wine chamber evaporator 6 in series, and the refrigerant may flow to the second wine chamber evaporator 7, the second wine chamber evaporator outlet path 72, the first wine chamber evaporator inlet path 61, the first wine chamber evaporator 6 and the first wine chamber evaporator outlet path 62.

The refrigerator may include a second wine chamber fan 74 for circulating cool air of the second wine chamber W2 to the second wine chamber evaporator 7 and the second wine chamber W2.

The freezing chamber evaporator 8 may be connected with a freezing chamber evaporator inlet path 81 and a freezing chamber evaporator outlet path 82 to cool the freezing chamber F. The freezing chamber evaporator outlet path 82 may be connected to the compressor suction path 11. The refrigerant, which has passed through the freezing chamber evaporator 8, may be sucked into the compressor 1 through the freezing chamber evaporator outlet path 82 and the compressor suction path 11.

The valve 86 for preventing the refrigerant from flowing back to the freezing chamber evaporator 8 may be provided at the freezing chamber evaporator outlet path 82. The valve 86 may be a check valve for allowing the refrigerant of the freezing chamber evaporator 3 to flow in one direction to be sucked into the compressor 1. The refrigerator may cool the freezing chamber F alone and then cool the first wine chamber W1 and the second wine chamber W2 together or cool the first wine chamber W1 alone. Since the first evaporator 6 has relatively higher pressure than the third evaporator 8, and the refrigerant, which has passed through the first wine chamber evaporator 6, may flow to the freezing chamber evaporator 8 having relatively lower pressure. However, if the valve 86 is installed on the freezing chamber evaporator outlet path 82, the refrigerant passing through the first wine chamber evaporator outlet path 62 is prevented from flowing to the freezing chamber evaporator 8.

The refrigerator may include a freezing chamber fan 84 for circulating cool air of the freezing chamber F to the freezing chamber evaporator 8 and the freezing chamber F.

Meanwhile, the refrigerator may further include a first wine chamber heater 68 disposed in the first wine chamber W1 to heat the first wine chamber W1. The first wine chamber heater 68 may be turned on while the compressor 1 is stopped, and, when the first wine chamber fan 64 is driven, cool air of the first wine chamber W1 may be circulated to the first wine chamber heater 68 and in the first wine chamber W1 to heat the first wine chamber W1.

The refrigerator may further include a second wine chamber heater 78 disposed in the second wine chamber W2 to heat the second wine chamber W2. The second wine chamber heater 78 may be turned on while the compressor 1 is stopped, and, when the second wine chamber fan 74 is driven, cool air of the second wine chamber W2 may be circulated to the second wine chamber heater 78 and in the second wine chamber W2 to heat the second wine chamber W2.

The refrigerator may further include a defrosting heater 88 for defrosting the freezing chamber evaporator 8. The defrosting heater 88 may be disposed around the freezing chamber evaporator 8 to defrost the freezing chamber evaporator 8.

The defrosting heater 88 may be turned on while the compressor 1 is stopped, and, when the freezing chamber fan 84 is driven, cool air of the freezing chamber F may be circulated to the defrosting heater 88, to the freezing chamber evaporator 8 and in the freezing chamber F to heat the freezing chamber evaporator 8 and to defrost the freezing chamber evaporator 8.

The path switching device 10 may regulate the refrigerant flowing through the wine chamber evaporators 6 and 7 and the freezing chamber evaporator 8, and may operate in a wine chamber mode in which the refrigerant condensed in the condenser 2 is guided to the wine chamber evaporators 6 and 7 or in a freezing chamber mode in which the refrigerant condensed in the condenser 2 is guided to the freezing chamber evaporator.

The path switching device 10 may be connected with the condenser outlet path 22. In addition, the path switching device 10 may be connected with the first wine chamber evaporator inlet path 61, the second wine chamber evaporator inlet path 71 and the freezing chamber evaporator inlet path 81.

The path switching device 10 may be composed of a single valve. In this case, the path switching device 10 may be composed of a four-way valve connected to the condenser outlet path 22, the first wine chamber evaporator inlet path 61, the second wine chamber evaporator inlet path 71 and the freezing chamber evaporator inlet path 81.

The path switching device 10 may be composed of a combination of a plurality of valves and, in this case, the path switching device 10 may include a first three-way valve 11 connected with the condenser outlet path 22 and the freezing chamber evaporator inlet path 81, a second three-way valve 12 connected with the first wine chamber evaporator inlet path 61 and the second wine chamber evaporator inlet path 71, and a three-way valve connection path 13 connecting the first three-way valve 11 with the second three-way valve 12.

The refrigerator may be in a cycle in which the second wine chamber evaporator 7 and the first wine chamber evaporator 6 are connected in series, the refrigerant bypasses the second wine chamber evaporator 7 and flows to the first wine chamber evaporator 6, and the first wine chamber evaporator 6 and the second wine chamber evaporator 7 connected in series are connected to the freezing chamber evaporator 8 in parallel.

The refrigerator may include a first temperature sensor 69 disposed in the first wine chamber W1 to sense the temperature of the first wine chamber, a second temperature sensor 79 disposed in the second wine chamber W2 to sense the temperature of the second wine chamber, and a third temperature sensor 89 disposed in the freezing chamber F to sense the temperature of the freezing chamber.

The controller 220 may control the compressor 1, the wine chamber fans 64 and 74, the freezing chamber fan 84 and the defrosting heater 88.

The controller 220 may control the compressor 1, the path switching device 10, the wine chamber fans 64 and 74 and the freezing chamber fan 84 according to a first wine chamber temperature sensed by the first temperature sensor 69, a second wine chamber temperature sensed by the second temperature sensor 79 and a freezing chamber storage temperature sensed by the third temperature sensor 89.

The controller 220 may perform a cooling operation of the refrigerator if any one of a condition that the first wine chamber temperature is dissatisfied, a condition that the second wine chamber temperature is dissatisfied and a condition that the freezing chamber temperature is dissatisfied is satisfied, drive the compressor 1, and control the path switching device 10 to a cooling mode.

The controller 220 may drive the condensing fan 24 upon driving the compressor 1. In addition, the controller 220 may drive the first wine chamber fan 64 in a mode in which the refrigerant flows to the first wine chamber evaporator 6, drive the second wine chamber fan 74 in a mode in which the refrigerant flows to the second wine chamber evaporator 7, and drive the freezing chamber fan 84 in a mode in which the refrigerant flows to the freezing chamber evaporator 8.

The refrigerator may perform defrosting operation in the middle of cooling operation or when a defrosting condition is satisfied while the cooling operation is stopped. The controller 220 may turn on the defrosting heater 88 in the middle of defrosting operation, and defrost the freezing chamber evaporator 8.

Figure 4:
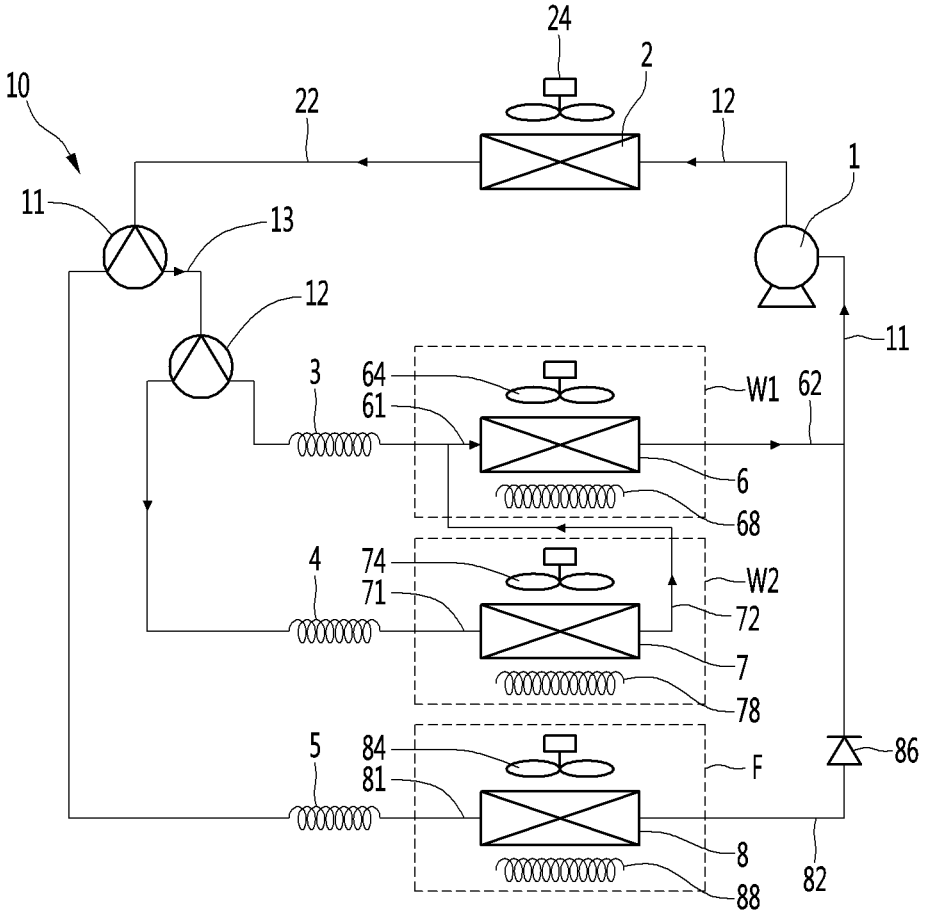
FIG. 4 is a view showing flow of refrigerant when the refrigerator according to the embodiment of the present disclosure is in a first cooling mode.
Figure 5:
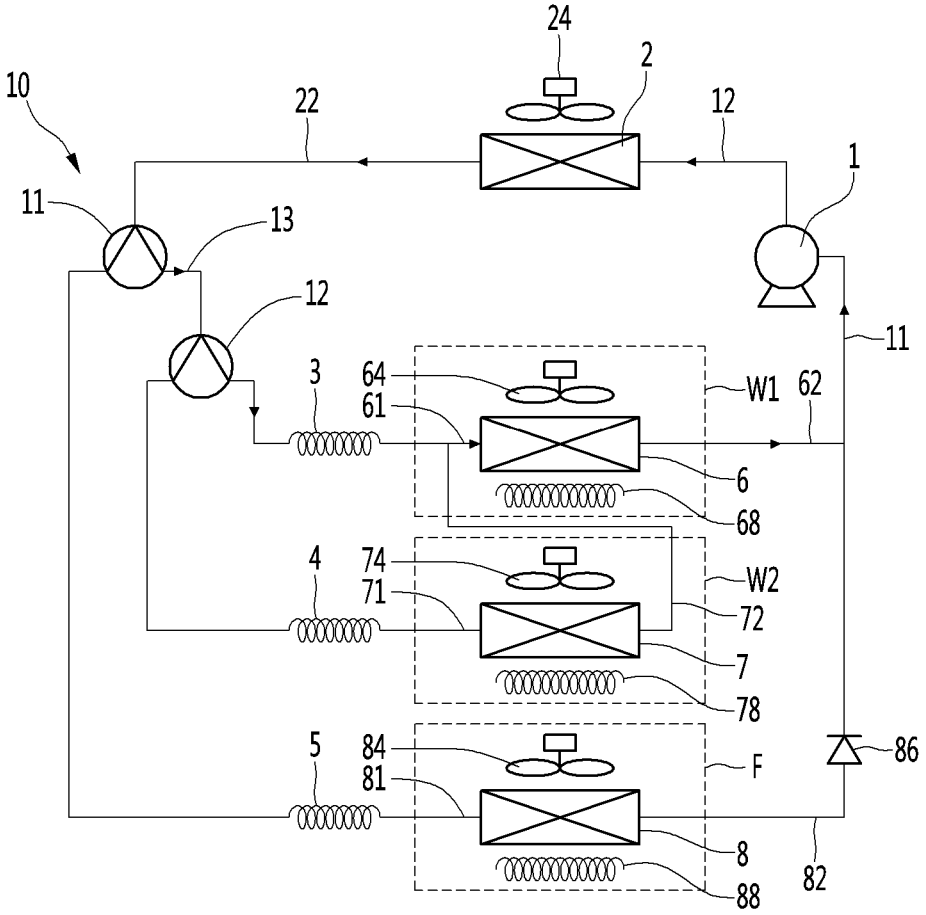
FIG. 5 is a view showing flow of refrigerant when the refrigerator according to the embodiment of the present disclosure is in a second cooling mode.
Figure 6:
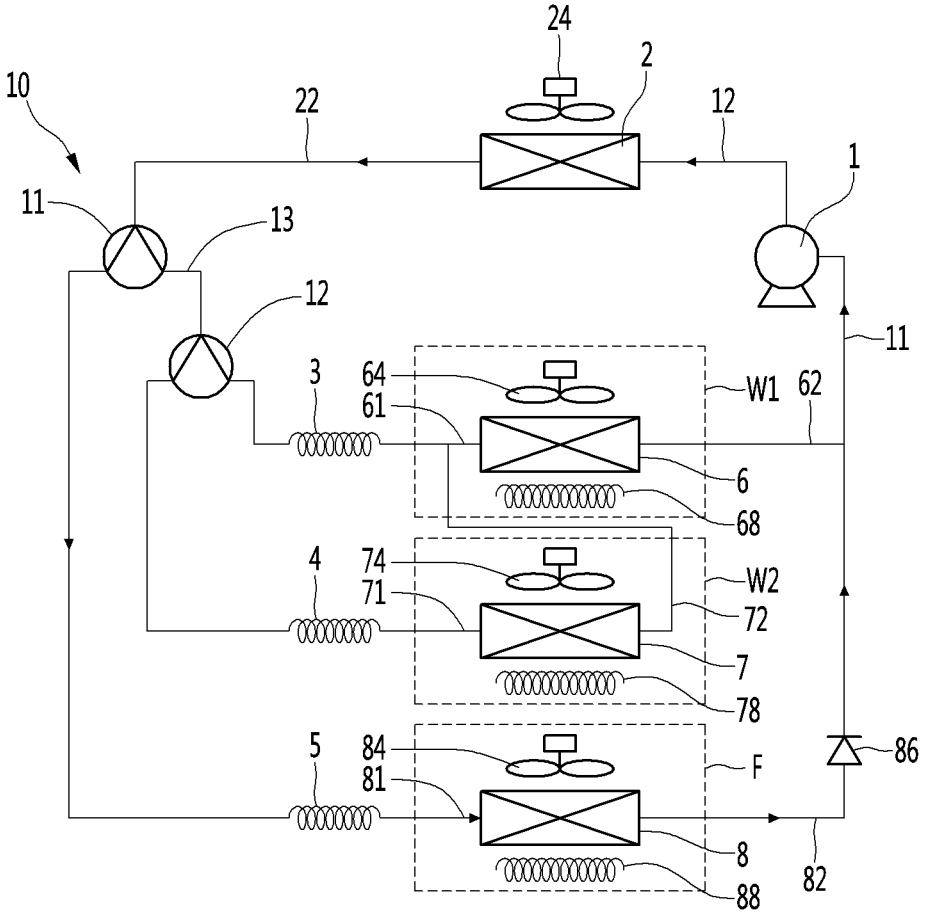
FIG. 6 is a view showing flow of refrigerant when the refrigerator according to the embodiment of the present disclosure is in a third cooling mode.

FIGS. 4 to 6 are views showing flow of refrigerant when the refrigerator performs cooling operation. The common configurations of the first wine chamber W1 and the second wine chamber W2 will be described as the wine chambers W1 and W2 and different configurations of the first wine chamber W1 and the second wine chamber W2 will be described as the first wine chamber W1 and the second wine chamber W2.

The cooling operation of the refrigerator may include a wine chamber cooling mode in which the refrigerant is supplied to the wine chamber evaporators 6 and 7 to cool the wine chambers W1 and W2 and a freezing chamber cooling mode in which the refrigerant is supplied to the freezing chamber evaporator 8. In one example, the cooling operation of the refrigerator may be performed in an order of the wine chamber cooling mode and the freezing chamber cooling mode, and the wine chamber cooling mode may resume after the freezing chamber cooling mode.

The wine chamber cooling mode may include a first cooling mode in which the first wine chamber W1 and the second wine chamber W2 are cooled and a second cooling mode in which only the first wine chamber W1 of the first wine chamber W1 and the second wine chamber W2 is cooled.

FIG. 4 is a view showing flow of refrigerant when the refrigerator shown in FIG. 1 is in a first cooling mode.

As shown in FIG. 4, the controller 220 may perform the first cooling mode for controlling the path switching device 10 to a second wine chamber evaporator supply mode such that the refrigerant is supplied to both the first wine chamber evaporator 6 and the second wine chamber evaporator 7.

The controller 220 may control the first three-way valve 11 to a second three-way valve guide mode and control the second three-way valve 12 to a second wine chamber evaporator guide mode, in the first cooling mode.

Start/termination of the first cooling mode may be determined according to satisfaction/dissatisfaction of the second wine chamber temperature, and the first cooling mode may start if the second wine chamber temperature is dissatisfied and terminates if the second wine chamber temperature is satisfied.

The controller 220 may drive the first wine chamber fan 64 and the second wine chamber fan 74 while driving the compressor 1, and drive the condensing fan 24, in the first cooling mode. In addition, the controller 220 may maintain stoppage of the freezing chamber fan 84 in the first cooling mode.

In the first cooling mode, as shown in FIG. 4, the refrigerant compressed in the compressor 1 may be condensed while passing through the condenser 2 and guided to the second expansion device 4 by the path switching device 10. The refrigerant guided to the second expansion device 4 may be decompressed by the second expansion device 4, cool the second wine chamber W2 while passing through the second wine chamber evaporator 7, and cool the first wine chamber W1 while passing through the first wine chamber evaporator 6. As described above, the refrigerant, which has sequentially passed through the second wine chamber evaporator 7 and the first wine chamber evaporator 6, may be sucked into the compressor 1.

In the first cooling mode, the first wine chamber W1 and the second wine chamber W2 may be cooled together and may be cooled independently of the freezing chamber F.

In the first cooling mode, the refrigerant may pass through the second wine chamber evaporator 7 and the first wine chamber evaporator 6 in this order and the temperature of the second wine chamber may be satisfied earlier than the temperature of the first wine chamber.

The controller 220 may stop the second wine chamber fan 74 if the temperature of the second wine chamber is satisfied in the first cooling mode.

FIG. 5 is a view showing flow of refrigerant when the refrigerator shown in FIG. 1 is in a second cooling mode.

As shown in FIG. 5, the controller 220 may perform the second cooling mode (first wine chamber W1 cooling) for controlling the path switching device 10 to the first wine chamber evaporator supply mode such that refrigerant is supplied to the first wine chamber evaporator 6. The controller 220 may control the first three-way valve 11 to the second three-way valve guide mode and control the second three-way valve 12 to the first wine chamber evaporator guide mode, in the second cooling mode.

Start/termination of the second cooling mode (first wine chamber W1 cooling) may be determined according to satisfaction/dissatisfaction of the first wine chamber temperature, and the second cooling mode may start if the first wine chamber temperature is dissatisfied and terminate if the first wine chamber temperature is satisfied. The controller 220 may perform the second cooling mode until the temperature of the first wine chamber W1 is satisfied after the second cooling mode starts.

In the second cooling mode, the controller 220 may drive the first wine chamber fan 64 while driving the compressor 1, and may drive the condensing fan 24. In addition, the controller 220 may maintain stoppage of the second wine chamber fan 74 and the freezing chamber fan 84.

In the second cooling mode, as shown in FIG. 5, the refrigerant compressed in the compressor 1 may be condensed while passing through the condenser 2 and guided to the first expansion device 3 by the path switching device 10. The refrigerant guided to the first expansion device 3 may be decompressed by the first expansion device 3, may cool the first wine chamber W1 while passing through the first wine chamber evaporator 6, and then may be sucked into the compressor 1.

In the second cooling mode, the first wine chamber W1 may be cooled, and may be cooled alone independently of the second wine chamber W2 and the freezing chamber F.

The controller 220 may stop the first wine chamber fan 64 when the first wine chamber temperature is satisfied in the middle of the second cooling mode.

FIG. 6 is a view showing flow of refrigerant when the refrigerator shown in FIG. 1 is in a third cooling mode.

As shown in FIG. 6, the controller 220 may perform the third cooling mode for controlling the path switching device 10 to the freezing chamber evaporator supply mode such that refrigerant is supplied to the freezing chamber evaporator 8. The controller 220 may control the first three-way valve 11 to the freezing chamber evaporator supply mode in the third cooling mode.

Start/termination of the third cooling mode may be determined according to satisfaction/dissatisfaction of the freezing chamber temperature, and the third cooling mode may start if the freezing chamber temperature is dissatisfied and terminate if the freezing chamber temperature is satisfied. The controller 220 may perform the third cooling mode until the freezing chamber temperature is satisfied, after the freezing chamber temperature is dissatisfied. The controller 220 may perform the third cooling mode until the freezing chamber temperature is satisfied after the temperature of the first wine chamber is satisfied.

In the third cooling mode, as shown in FIG. 6, the refrigerant compressed in the compressor 1 may be condensed while passing through the condenser 2 and guided to the freezing chamber expansion device 5 by the path switching device 10. The refrigerant guided to the freezing chamber expansion device 5 may be decompressed by the freezing chamber expansion device 5, may cool the freezing chamber F while passing through the freezing chamber evaporator 8, and may be sucked into the compressor 1.

In the third cooling mode, the freezing chamber F may be cooled alone.

The controller 220 may stop the freezing chamber fan 84 if the freezing chamber temperature is satisfied in the middle of the third cooling mode.

The controller 220 may selectively perform the first cooling mode (see FIG. 4), the second cooling mode (see FIG. 5) and the third cooling mode (see FIG. 6).

The controller 220 may sequentially perform the first cooling mode, the second cooling mode and the third cooling mode. In addition, the controller 220 may resume the first cooling mode after the third cooling mode.

The controller 220 may terminate the third cooling mode and immediately perform the first cooling mode, if the freezing chamber temperature is satisfied and the second wine chamber temperature is dissatisfied in the middle of the third cooling mode.

In contrast, the controller 220 may stop the compressor 1 until the second wine chamber temperature is dissatisfied after the third cooling mode terminates, if the freezing chamber temperature is satisfied and the second wine chamber temperature is satisfied in the middle of the third cooling mode, and perform the first cooling mode if the second wine chamber temperature is dissatisfied while the compressor 1 is stopped.

When the refrigerator is controlled to the first cooling mode, the second cooling mode and the third cooling mode, the refrigerator may cool the first wine chamber W1 and the second wine chamber W2 together, cool the first wine chamber W1, and then cool the freezing chamber F.

In this case, the first wine chamber W1 and the second wine chamber W2, which need to be maintained at a constant temperature, of the refrigerator may be cooled prior to the freezing chamber F. In particular, in the first cooling mode, since the first wine chamber W1 and the second wine chamber W2 are cooled together, it is possible to rapidly cool both the first wine chamber W1 and the second wine chamber W2.

Figure 7:
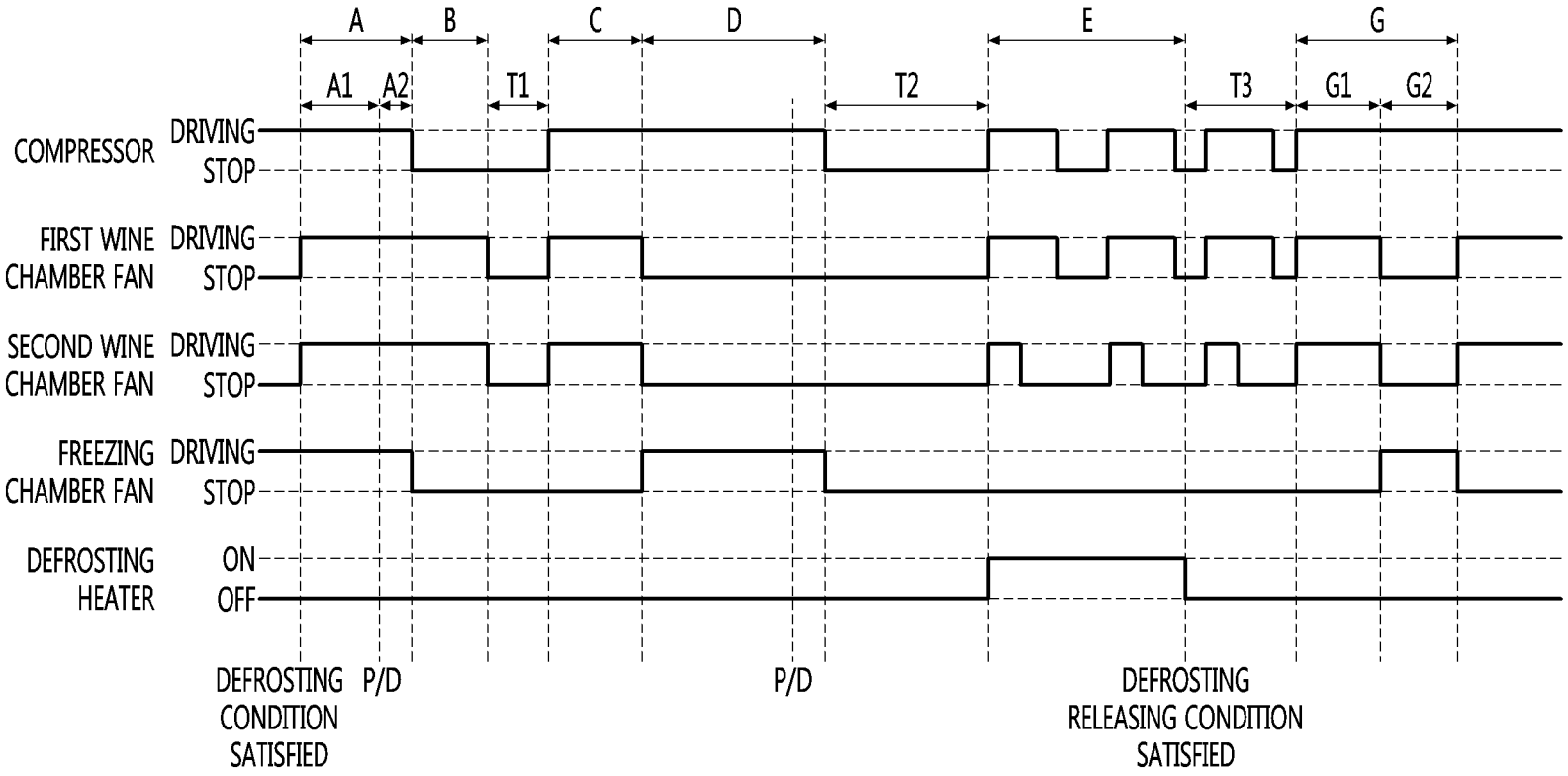
FIG. 7 is a view showing change in driving of a compressor, a wine chamber fan, a freezing chamber fan and a defrosting fan while the refrigerator shown in FIG. 1 performs defrosting operation.

FIG. 7 is a view showing change in the compressor, the wine chamber fan, the freezing chamber fan and the defrosting fan while the refrigerator shown in FIG. 1 performs defrosting operation.

The controller 220 may start defrosting operation when a defrosting condition is satisfied, and perform a freezing chamber defrosting mode E for defrosting the freezing chamber evaporator 8 using the defrosting heater 88 in the middle of defrosting operation. The controller 220 may cool the wine chambers W1 and W2 according to the temperatures of the wine chambers while the defrosting heater 88 is turned on to defrost the freezing chamber evaporator 8, that is, in the middle of the freezing chamber defrosting mode E.

The controller 220 may perform a natural defrosting mode for naturally defrosting the wine chamber evaporators 6 and 7 by the cool air of the wine chambers W1 and W2 before performing the freezing chamber defrosting mode E.

The controller 220 may perform a freezing chamber additional cooling mode A for cooling the freezing chamber F before performing the freezing chamber defrosting mode E.

The controller 220 may perform a wine chamber additional defrosting mode B for defrosting the wine chamber before performing the freezing chamber defrosting mode E.

The controller 220 may perform a wine chamber pre-cool mode C for pre-cooling the wine chambers W1 and W2 before performing the freezing chamber defrosting mode E.

The controller 220 may perform a freezing chamber pre-cool mode D for pre-cooling the freezing chamber F before performing the freezing chamber defrosting mode E.

The controller 220 may perform an alternating cooling mode G for alternately cooling the wine chambers W1 and W2 and the freezing chamber F after performing the freezing chamber defrosting mode E.

Hereinafter, the defrosting operation will be described with reference to FIG. 7.

The controller 220 may sequentially perform the freezing chamber additional cooling mode A, the wine chamber additional defrosting mode B, the wine chamber pre-cool mode C, the freezing chamber pre-cool mode D, the freezing chamber defrosting mode E and the alternate cooling mode G.

The controller 220 may start the wine chamber pre-cool mode C without performing the freezing chamber additional cooling mode A and the wine chamber additional defrosting mode B among the modes A, B, C, D, E and G of the defrosting operation. Meanwhile, the controller 220 may start the freezing chamber defrosting mode E without performing the freezing chamber additional cooling mode A, the wine chamber additional defrosting mode B, the wine chamber pre-cool mode C and the freezing chamber pre-cool mode D. In addition, the controller 220 may terminate the defrosting operation when the freezing chamber defrosting mode E terminates without performing the alternate cooling mode G.

Hereinafter, an example in which the controller 220 sequentially performs the freezing chamber additional cooling mode A, the wine chamber additional defrosting mode B, the wine chamber pre-cool mode C, the freezing chamber pre-cool mode D, the freezing chamber defrosting mode E and the alternate cooling mode G in the defrosting operation will be described.

The controller 220 may first perform the freezing chamber additional cooling mode A for additionally cooling the freezing chamber F when the defrosting condition of the freezing chamber evaporator 8 is satisfied.

The defrosting condition of the freezing chamber evaporator 8 may be determined by at least one of a set defrosting period, an added-up operation time of the compressor 1 and a temperature of the freezing chamber evaporator 8.

In an example of the defrosting operation, the controller 220 may start the defrosting operation at the set defrosting period (e.g., 24 hours). In this case, the controller 220 may start the defrosting operation according to a time counted by a timer (not shown).

In another example of the defrosting operation, the controller 220 may add up the operation time of the compressor 1 to count the added-up operation time of the compressor using a counter (not shown) and start the defrosting operation when the counted added-up operation time of the compressor reaches a reference added-up time. In this case, the controller 220 may compare the added-up operation time of the compressor 1 with the reference added-up time or compare only the added-up operation time of the third cooling mode with the reference added-up time, regardless of the first cooling mode to the third cooling mode.

In another example of the defrosting operation, when the temperature sensed by a defrosting sensor (not shown) for sensing the temperature of the freezing chamber evaporator 8 reaches a defrosting start temperature, the defrosting operation may start. In this case, the controller 220 may start defrosting operation if the temperature sensed by the defrosting sensor corresponds to a defrosting start temperature.

Start of the defrosting operation may be determined by a combination of the above examples, and also may be determined using various methods in addition to the above examples.

The controller 220 may perform a first mode A1 for driving the compressor 1, the freezing chamber fan 84 and the wine chamber fans 64 and 74 in the freezing chamber additional cooling mode A, upon starting the defrosting operation. In this case, the controller 220 may control the path switching device 10 to the freezing chamber mode.

In the above control operation, the refrigerant compressed in the compressor 1 may be sucked into the compressor 1 after sequentially passing through the condenser 2, the path switching device 10, the freezing chamber expansion device 5 and the freezing chamber evaporator 8, and the temperature of the freezing chamber F may be decreased in advance before defrosting the freezing chamber evaporator 8 by the defrosting heater 88.

The controller 220 may perform a second mode A2 for pumping down (P/D) the refrigerator after the first mode A1. The second mode may be a mode for closing the path switching device 10 while the compressor 1 is driven after starting the freezing chamber additional cooling mode A.

The second mode A2 may be performed when an additional set time (e.g., 60 minutes) has elapsed after the freezing chamber additional cooling mode A or when the temperature of the freezing chamber F is satisfied.

The compressor 1 which has been driven in the first mode A1 may be continuously driven and the refrigerant remaining in the freezing chamber evaporator 8 may be sucked into the compressor 1 and accumulated between the compressor 1 and the path switching device 10. Such pump-down (P/D) may minimize an amount of the refrigerant remaining in the freezing chamber evaporator 8 before defrosting the freezing chamber evaporator 8 by the defrosting heater 88 and may shorten a time when the freezing chamber evaporator 8 is defrosted by the defrosting heater 88 in the freezing chamber defrosting mode E.

The controller 220 may stop the compressor 1 and the freezing chamber fan 84 when the pump-down set time has elapsed after the second mode A2. The pump-down set time may be set to a time required to minimize the amount of refrigerant remaining in the freezing chamber evaporator 8 and may be set to, for example, a predetermined time of 1 minute or 3 minutes.

When the pump-down set time has elapsed, pump-down (P/D) may terminate and the freezing chamber additional cooling mode A may terminate.

Meanwhile, in the freezing chamber additional cooling mode A, the wine chamber fans 64 and 74 may be continuously driven, the cool air of the wine chambers W1 and W2 may be circulated to the wine chamber evaporators 6 and 7 and in the wine chambers W1 and W2, and the wine chamber evaporators 6 and 7 may be naturally defrosted by the cool air of the wine chambers W1 and W2.

The refrigerator may simultaneously defrost the wine chamber evaporators 5 and 6 while decreasing the temperature of the freezing chamber F in advance, before defrosting the freezing chamber evaporator 8 by the defrosting heater 88.

The controller 220 may perform the wine chamber additional defrosting mode B for additionally driving the wine chamber fan 84, after stopping the compressor 1 and the freezing chamber fan 84. The wine chamber additional defrosting mode B may terminate when a set additional driving time has elapsed after the wine chamber additional defrosting mode starts or when the temperature of the wine chamber reaches a natural defrosting terminating temperature.

The natural defrosting termination temperature may be set to a temperature determined as defrosting termination of the wine chamber evaporators 6 and 7, such as 10° C.

The set additional driving time may be set such that the wine chamber evaporators 6 and 7 are sufficiently naturally defrosted, that is, may be set to 120 minutes.

The wine chamber additional defrosting mode B may be a mode in which the wine chamber fans 64 and 74 may be driven alone in a state of stopping the compressor 1 and the freezing chamber fan 84, and the wine chamber evaporators 6 and 7 may be further naturally defrosted even after pump-down (P/D) terminates.

When the temperature of the wine chamber reaches the natural defrosting termination temperature or when the set additional driving time has elapsed after pump-down (P/D) terminates, the controller 220 may stop the wine chamber fans 64 and 74 which have been driven since a time when the freezing chamber additional cooling mode A started, and terminate the wine chamber additional defrosting mode B.

As the freezing chamber additional cooling mode A and the wine chamber additional defrosting mode B are sequentially performed, the wine chamber evaporators 6 and 7 may be naturally defrosted for a sufficient time, and the refrigerator may defrost the freezing chamber evaporator 8 in the freezing chamber defrosting mode E after the wine chamber evaporators 6 and 7 may be naturally defrosted in the freezing chamber additional cooling mode A and the wine chamber additional defrosting mode B.

The freezing chamber additional cooling mode A and the wine chamber additional defrosting mode B may be a wine chamber evaporator defrosting mode, as compared with the freezing chamber defrosting mode E which is a freezing chamber evaporator defrosting mode.

Meanwhile, the wine chamber pre-cool mode C may start when a set stopping time T1 has elapsed after the wine chamber additional defrosting mode B terminates.

The controller 220 may start the wine chamber pre-cool mode C when the cycle is stabilized after pump-down (P/D) and defrosting of the wine chamber evaporator. The set stopping time T1 may be set to a time required to sufficiently stabilize the cycle, such as 3 minutes or 5 minutes.

The controller 220 may drive the compressor 1, drive the wine chamber fans 64 and 74, and control the path switching device 10 to the wine chamber mode, in the wine chamber pre-cool mode C.

In the wine chamber pre-cool mode C, the refrigerant compressed in the compressor 1 may be sucked into the compressor 1 after sequentially passing through the condenser 2, the wine chamber expansion devices 3 and 4 and the wine chamber evaporators 6 and 7, and the refrigerator may decrease the temperatures of the wine chambers W1 and W2 in advance before defrosting the freezing chamber evaporator 8 by the defrosting heater 88.

The wine chamber pre-cool mode C may terminate after a first set time (e.g., 10 minutes) has elapsed after the wine chamber pre-cool mode C starts.

The first set time may be set to a time required to sufficiently decrease the temperatures of the wine chambers and may be set such that the wine chambers W1 and W2 are not supercooled.

The controller 220 may stop the wine chamber fans 64 and 74, drive the freezing chamber fan 84 and control the path switching device 10 to the freezing chamber mode to perform the freezing chamber pre-cool mode D, in the middle of the wine chamber pre-cool mode C.

In the freezing chamber pre-cool mode D, the refrigerant compressed in the compressor 1 may be sucked into the compressor 1 after sequentially passing through the condenser 2, the freezing chamber expansion device 5 and the freezing chamber evaporator 8, and the refrigerator may decrease the temperatures of the freezing chamber F in advance before defrosting the freezing chamber evaporator 8 by the defrosting heater 88.

The freezing chamber pre-cool mode D may terminate when a second set time (e.g., 30 minutes) has elapsed after the freezing chamber pre-cool mode D starts or if the temperature of the freezing chamber is lower than the target temperature of the freezing chamber by a set temperature.

The set temperature may be set to a relatively large temperature and may be set to, for example, a temperature at which the freezing chamber F may be determined to be supercooled, such as 4° C. or 4.5° C.

When the temperature of the freezing chamber reaches a temperature obtained by subtracting the set temperature (e.g., 4° C. or 4.5° C.) from the target temperature of the freezing chamber in the middle of the freezing chamber pre-cool mode D, it may be determined that the freezing chamber F is sufficiently cooled by the freezing chamber pre-cool mode D, and the controller 220 may terminate the freezing chamber pre-cool mode D even before the second set time has elapsed after the freezing chamber pre-cool mode D starts.

The second set time may be set to a time required to sufficiently decrease the temperature of the freezing chamber and may be set to a temperature, at which the freezing chamber is not supercooled, such as 30 minutes.

The second set time may be greater than the first set time. The wine chambers W1 and W2 may have a relatively temperature range greater than the freezing chamber F, and thus the temperature thereof may decrease by cooling for a relative short time. In contrast, the freezing chamber F has a relatively lower temperature range than the wine chambers W1 and W2, and thus needs a longer cooling time than the wine chambers W1 and W2.

The freezing chamber pre-cool mode D may terminate when the pump-down set time has elapsed after pump-down (P/D), as in the freezing chamber additional cooling mode A. In this case, the controller 220 may perform pump-down (P/D) when the temperature of the freezing chamber is lower than the target temperature of the freezing chamber by a set temperature in the middle of the freezing chamber pre-cool mode D or when the second set time (e.g., 30 minutes) has elapsed after the freezing chamber pre-cool mode D starts, and terminate the freezing chamber pre-cool mode D after performing pump-down (P/D) during the pump-down set time.

The controller 220 may start the freezing chamber defrosting mode E after terminating the freezing chamber pre-cool mode D.

The freezing chamber defrosting mode E may start when a set stopping time T2 has elapsed after terminating the freezing chamber pre-cool mode D.

The controller 220 may start the freezing chamber defrosting mode E after the cycle is stabilized after terminating the freezing chamber pre-cool mode D. The set stopping time T2 may be set to a time required to sufficiently stabilize the cycle, such as 3 minutes or 5 minutes.

The controller 220 may turn on the defrosting heater 88 to defrost the freezing chamber evaporator 8 in the freezing chamber defrosting mode E. When the defrosting heater 88 is turned on, the defrosting heater 88 may heat the freezing chamber evaporator 8, and the freezing chamber evaporator 8 may be gradually defrosted over time.

The refrigerator may gradually heat the wine chambers W1 and W2 while the freezing chamber evaporator 8 is defrosted.

If the temperature of the wine chamber is dissatisfied in the middle of the freezing chamber defrosting mode E, the controller 220 may drive the compressor 1 while the temperature of the wine chamber is dissatisfied, control the path switching device 10 to the wine chamber mode, and drive the wine chamber fans 64 and 74.

In the freezing chamber defrosting mode E, the controller 220 may enable the refrigerant to flow to the wine chamber evaporators 6 and 7 while the refrigerant does not flow to the freezing chamber evaporator 8. The refrigerant may be sucked into the compressor 1 after sequentially passing through the compressor 1, the condenser 2, the path switching device 10, the wine chamber expansion devices 3 and 4 and the wine chamber evaporators 6 and 7.

In the freezing chamber defrosting mode E, the refrigerator may simultaneously perform cooling of the wine chambers W1 and W2 and defrosting of the freezing chamber evaporator F and maintain the wine chambers W1 and W2 at a constant temperature as much as possible without heating even when the freezing chamber defrosting mode E is performed for a long time.

When the temperature of the wine chamber is dissatisfied in the middle of the freezing chamber defrosting mode E, the controller 220 may drive the compressor 1, control the path switching device 10 to the wine chamber mode, and drive the wine chamber fans 64 and 74. In addition, when the temperature of the wine chamber is satisfied in the middle of the freezing chamber defrosting mode E, the controller 220 may stop the compressor 1 and stop the wine chamber fans 64 and 74.

The controller 220 may perform cooling and stopping of cooling in the wine chambers W1 and W2 at least twice according to the temperature of the wine chamber in the middle of the freezing chamber defrosting mode E.

The controller 220 may terminate the freezing chamber defrosting mode E if a defrosting releasing condition is satisfied in the middle of the freezing chamber defrosting mode E.

The defrosting releasing condition may be a condition in which the freezing chamber evaporator 8 is determined to have been sufficiently defrosted and may include the case where the temperature of the freezing chamber evaporator sensed by a defrosting sensor is equal to or greater than a defrosting termination set temperature (e.g., 5° C.) or the case where a defrosting termination set time (e.g., 120 minutes) has elapsed after the freezing chamber defrosting mode E.

The controller 220 may turn off the defrosting heater 88 under the defrosting releasing condition.

The controller 220 may not immediately perform the alternate cooling mode G and wait for the alternate cooling mode G during a set waiting time T3 (e.g., 3 minutes), after the defrosting heater 88 is turned off.

In addition, the controller 220 may repeat cooling and stop of cooling of the wine chambers W1 and W2 according to the temperature of the wine chamber during the set waiting time T3. In this time, the wine chambers W1 and W2 may be maintained at a constant temperature for the set waiting time T3.

The controller 220 may perform the alternate cooling mode G when the set waiting time T3 (e.g., 3 minutes) has elapsed after the defrosting heater 88 is turned off.

The alternate cooling mode G refers to a mode in which the wine chambers W1 and W2 and the freezing chamber F are alternately cooled. The controller 220 may alternately cool the wine chambers W1 and W2 and the freezing chamber F after terminating the freezing chamber defrosting mode E.

The controller 220 may alternately perform a wine chamber cooling mode G1 for driving the wine chamber fans 64 and 74 and controlling the path switching device 10 to the wine chamber mode while stopping the freezing chamber fan 84 and a freezing chamber mode G2 for driving the freezing chamber fan 84 and controlling the path switching device 10 to the freezing chamber mode while stopping the wine chamber fans 64 and 74, in the alternate cooling mode G.

The controller 220 may drive the compressor 1 in the alternate cooling mode G.

The controller 220 may first start the wine chamber cooling mode G1 when the set waiting time (e.g., 3 minutes) has elapsed after terminating the freezing chamber defrosting mode E.

The controller 220 may perform the wine chamber cooling mode G1 and the freezing chamber mode G2 for the same set time (e.g., 10 minutes).

The controller 220 may terminate the alternate cooling mode G when the temperature of the freezing chamber is satisfied in the middle of the alternate cooling mode G.

The controller 220 may terminate defrosting operation when the alternate cooling mode G terminates, and then cool the refrigerator according to the temperature of the wine chamber and the temperature of the freezing chamber as shown in FIGS. 4 to 6.

According to the embodiments of the disclosure, since the wine chamber may be cooled by the wine chamber evaporator in the middle of defrosting operation of the freezing chamber evaporator, it is possible to minimize rapid rise of the temperature of the wine chamber and to maintain the wine chamber at a constant temperature as much as possible during operation of the refrigerator.

In the meantime, the present invention is not limited to the above-described embodiment, and the freezing chamber may be the switchable chamber/the non-wine chamber/the non-constant temperature chamber/the subordinate chamber. Additionally, the freezing chamber fan can be a switchable chamber fan/a non-wind chamber fan/a subordinate chamber fan, and a wine chamber fan can be a constant temperature chamber fan/a priority chamber fan.

The above-disclosed subject matter is to be considered illustrative, and not restrictive, and the appended claims are intended to cover all such modifications, enhancements, and other embodiments, which fall within the scope of the present disclosure.

Thus, the embodiment of the present disclosure is to be considered illustrative, and not restrictive.

Therefore, the scope of the claimed invention is defined not by the detailed description of the disclosure but by the appended claims, and all differences within the scope will be construed as being included in the appended claims.

What is claimed is:

1. A refrigerator comprising:

a main body including a wine chamber and a freezing chamber;

a compressor to compress refrigerant;

a condenser to condense the refrigerant compressed in the compressor;

a freezing chamber evaporator to cool the freezing chamber;

a freezing chamber fan to circulate cool air of the freezing chamber in the freezing chamber and to the freezing chamber evaporator;

a defrosting heater to defrost the freezing chamber evaporator;

a wine chamber evaporator to cool the wine chamber;

a wine chamber fan to circulate cool air of the wine chamber in the wine chamber and to the wine chamber evaporator;

a valve to guide the refrigerant condensed in the condenser to the freezing chamber evaporator in a freezing chamber mode and to guide the refrigerant condensed in the condenser to the wine chamber evaporator in a wine chamber mode; and a controller configured to:

turn on the defrosting heater and to control the valve to the freezing chamber mode to perform a freezing chamber defrosting mode for defrosting the freezing chamber evaporator, and control the valve to the wine chamber mode and drive the compressor and the wine chamber fan while a temperature of the wine chamber is dissatisfied when the temperature of the wine chamber is dissatisfied in the freezing chamber defrosting mode, wherein the controller performs an alternate cooling mode for alternately cooling the wine chamber and the freezing chamber after terminating the freezing chamber defrosting mode, wherein the controller alternately performs a wine chamber cooling mode for driving the wine chamber fan and controlling the valve to the wine chamber mode while stopping the freezing chamber fan and a freezing chamber cooling mode for driving the freezing chamber fan and controlling the valve to the freezing chamber mode while stopping the wine chamber fan, in the alternate cooling mode, wherein the controller drives the compressor during the alternate cooling mode.

2. The refrigerator of claim 1, wherein the controller:

drives the compressor, drives the wine chamber fan, and controls the valve to the wine chamber mode to perform a wine chamber pre-cool mode;

stops the wine chamber fan in the wine chamber pre-cool mode, drives the freezing chamber fan, and controls the valve to the freezing chamber mode to perform a freezing chamber pre-cool mode, wherein the freezing chamber defrosting mode starts after terminating the freezing chamber pre-cool mode.

3. The refrigerator of claim 1, wherein the controller first starts the wine chamber cooling mode when a set waiting time has elapsed after terminating the freezing chamber defrosting mode.

4. The refrigerator of claim 1, wherein the controller performs the wine chamber cooling mode and the freezing chamber cooling mode for a same set time.

5. The refrigerator of claim 1, wherein the controller terminates the alternate cooling mode when a temperature of the freezing chamber is satisfied during the alternate cooling mode.

6. The refrigerator of claim 1, wherein the controller performs the defrosting of the freezing chamber evaporator when a defrosting condition is met determined by at least one of a set defrosting period, an added-up operation time of the compressor and a temperature of the freezing chamber evaporator.

7. The refrigerator of claim 1, wherein the controller sequentially performs the freezing chamber additional cooling mode, the wine chamber additional defrosting mode, the wine chamber pre-cool mode, the freezing chamber defrosting mode and the alternate cooling mode.

8. The refrigerator of claim 1, wherein the wine chamber evaporator is connected to the freezing chamber evaporator in parallel.

9. A refrigerator comprising:

a main body including a wine chamber and a freezing chamber;

a compressor to compress refrigerant;

a condenser to condense the refrigerant compressed in the compressor;

a freezing chamber evaporator to cool the freezing chamber;

a freezing chamber fan to circulate cool air of the freezing chamber in the freezing chamber and to the freezing chamber evaporator;

a defrosting heater to defrost the freezing chamber evaporator;

a wine chamber evaporator to cool the wine chamber;

a wine chamber fan to circulate cool air of the wine chamber in the wine chamber and to the wine chamber evaporator;

a valve to guide the refrigerant condensed in the condenser to the freezing chamber evaporator in a freezing chamber mode and to guide the refrigerant condensed in the condenser to the wine chamber evaporator in a wine chamber mode; and a controller configured to:

turn on the defrosting heater and to control the valve to the freezing chamber mode to perform a freezing chamber defrosting mode for defrosting the freezing chamber evaporator, and control the valve to the wine chamber mode and drive the compressor and the wine chamber fan while a temperature of the wine chamber is dissatisfied when the temperature of the wine chamber is dissatisfied in the freezing chamber defrosting mode, wherein the controller is configured to:

drive the compressor and the wine chamber fan, and control the valve to the wine chamber mode to perform a wine chamber pre-cool mode;

terminate the wine chamber pre-cool mode and stop the wine chamber fan when a first set time has elapsed after the wine chamber pre-cool mode starts;

drive the freezing chamber fan, and control the valve to the freezing chamber mode to perform a freezing chamber pre-cool mode; and terminate the freezing chamber pre-cool mode when a second set time has elapsed after the freezing chamber pre-cool mode starts or when a temperature of the freezing chamber is lower than a target temperature of the freezing chamber by a set temperature, the second set time being greater than the first set time, and wherein the freezing chamber defrosting mode starts after terminating the freezing chamber pre-cool mode.

10. The refrigerator of claim 9, wherein the controller performs a pump-down for continuously driving the compressor such that the refrigerant remaining in the freezing chamber evaporator is sucked into the compressor and accumulated between the compressor and the valve when a temperature of the freezing chamber is lower than a target temperature during the freezing chamber pre-cool mode or when the second set time has elapsed after the freezing chamber pre-cool mode has started.

11. The refrigerator of claim 10, wherein the controller terminates the freezing chamber pre-cool mode after performing pump-down during a pump-down set time.

12. The refrigerator of claim 10, wherein the controller starts the freezing chamber defrosting mode when a set stopping time has elapsed after the freezing chamber pre-cool mode terminates.

13. A refrigerator comprising:

a main body including a wine chamber and a freezing chamber;

a compressor to compress refrigerant;

a condenser to condense the refrigerant compressed in the compressor;

a freezing chamber evaporator to cool the freezing chamber;

a freezing chamber fan to circulate cool air of the freezing chamber in the freezing chamber and to the freezing chamber evaporator;

a defrosting heater to defrost the freezing chamber evaporator;

a wine chamber evaporator to cool the wine chamber;

a wine chamber fan to circulate cool air of the wine chamber in the wine chamber and to the wine chamber evaporator;

a valve to guide the refrigerant condensed in the condenser to the freezing chamber evaporator in a freezing chamber mode and to guide the refrigerant condensed in the condenser to the wine chamber evaporator in a wine chamber mode; and a controller configured to:

turn on the defrosting heater and to control the valve to the freezing chamber mode to perform a freezing chamber defrosting mode for defrosting the freezing chamber evaporator, and control the valve to the wine chamber mode and drive the compressor and the wine chamber fan while a temperature of the wine chamber is dissatisfied when the temperature of the wine chamber is dissatisfied in the freezing chamber defrosting mode, wherein the controller is configured to:

perform a freezing chamber additional cooling mode for additionally cooling the freezing chamber when a defrosting condition of the freezing chamber evaporator is satisfied, wherein performing the freezing chamber additional cooling mode includes:

performing a first mode for driving the compressor, driving the freezing chamber fan, driving the wine chamber fan, and controlling the valve to the freezing chamber mode, and performing a second mode for closing the valve when an additional set time has elapsed after the freezing chamber additional cooling mode starts or when a temperature of the freezing chamber is satisfied, in the freezing chamber additional cooling mode, drive the compressor, drive the wine chamber fan, and control the valve to the wine chamber mode to perform a wine chamber pre-cool mode;

stop the wine chamber fan in the wine chamber pre-cool mode, drive the freezing chamber fan, and control the valve to the freezing chamber mode to perform a freezing chamber pre-cool mode, wherein the freezing chamber defrosting mode starts after terminating the freezing chamber pre-cool mode.

14. The refrigerator of claim 13, wherein the controller performing the second mode performs a pump-down for continuously driving the compressor such that the refrigerant remaining in the freezing chamber evaporator is sucked into the compressor and accumulated between the compressor and the valve.

15. The refrigerator of claim 14, wherein the controller stops the compressor and the freezing chamber fan when a pump-down set time has elapsed after the second mode.

16. The refrigerator of claim 15, wherein the controller performing the second mode continuously drives the wine chamber fan.

17. The refrigerator of claim 16, wherein the controller performs a wine chamber additional defrosting mode for additionally driving the wine chamber fan after stopping the compressor and the freezing chamber fan.

18. The refrigerator of claim 17, wherein the controller terminates the wine chamber additional defrosting mode when a temperature of the wine chamber corresponds to a natural defrosting termination temperature or when a set additional driving time has elapsed after the wine chamber additional defrosting mode starts.

19. The refrigerator of claim 17, wherein the controller starts the wine chamber pre-cool mode when a set stopping time has elapsed after the wine chamber additional defrosting mode terminates.

20. The refrigerator of claim 19, wherein the controller sequentially performs the freezing chamber additional cooling mode, the wine chamber additional defrosting mode, the wine chamber pre-cool mode, the freezing chamber defrosting mode and an alternate cooling mode.

* * * * *